US006421947B1

(12) United States Patent
Fuller

(10) Patent No.: US 6,421,947 B1
(45) Date of Patent: Jul. 23, 2002

(54) AXIS ALIGNMENT APPARATUS

(75) Inventor: Jerome Keith Fuller, Van Nuys, CA (US)

(73) Assignee: Lyte Optronics, Inc., Torrance, CA (US)

( * ) Notice: Subject to any disclaimer, the term of this patent is extended or adjusted under 35 U.S.C. 154(b) by 0 days.

(21) Appl. No.: 09/624,124

(22) Filed: Jul. 24, 2000

(51) Int. Cl.[7] ..... F41G 1/00
(52) U.S. Cl. ..... 42/116
(58) Field of Search ..... 42/116, 117; 362/110

(56) References Cited

U.S. PATENT DOCUMENTS

| | | | | | |
|---|---|---|---|---|---|
| 2,268,056 | A | * | 12/1941 | Nelson et al. | 362/112 |
| 3,510,965 | A | * | 5/1970 | Rhea | 434/21 |
| 3,526,972 | A | * | 9/1970 | Sumpf | 434/22 |
| 3,573,868 | A | * | 4/1971 | Giannetti | 463/51 |
| 4,234,911 | A | * | 11/1980 | Faith | 362/111 |
| 4,825,258 | A | * | 4/1989 | Whitson | 356/153 |
| 4,891,476 | A | | 1/1990 | Nation et al. | 200/11 R |
| 4,939,320 | A | | 7/1990 | Graulty | 200/17 R |
| 5,001,836 | A | | 3/1991 | Cameron et al. | 33/234 |
| 5,178,265 | A | | 1/1993 | Sepke | 200/528 |
| 5,241,146 | A | | 8/1993 | Priesemuth | 200/531 |
| 5,343,376 | A | * | 8/1994 | Huang | 362/259 |
| 5,365,669 | A | | 11/1994 | Rustick et al. | 33/234 |
| 5,432,598 | A | * | 7/1995 | Szatkowski | 356/153 |
| 5,446,535 | A | * | 8/1995 | Williams | 356/153 |
| 5,448,834 | A | * | 9/1995 | Huang | 33/234 |
| 5,454,168 | A | | 10/1995 | Langner | 33/234 |
| 5,455,397 | A | | 10/1995 | Havenhill et al. | 200/61.39 |
| 5,531,040 | A | | 7/1996 | Moore | 42/103 |
| 5,618,099 | A | * | 4/1997 | Brubacher | 362/111 |
| 5,694,202 | A | | 12/1997 | Mladjan et al. | 356/4.01 |
| 5,694,713 | A | | 12/1997 | Paldino | 42/103 |
| 5,787,631 | A | | 8/1998 | Kendall | 42/103 |
| 5,842,300 | A | | 12/1998 | Cheshelski et al. | 42/103 |
| 5,847,345 | A | | 12/1998 | Harrison | 200/284 |
| 5,905,238 | A | | 5/1999 | Hung | 200/314 |

* cited by examiner

*Primary Examiner*—Charles T. Jordan
*Assistant Examiner*—Jordan J. Lofdahl
(74) *Attorney, Agent, or Firm*—David E. Rogers; Alexander B. Ching; Squire Sanders & Dempsey L.L.P.

(57) ABSTRACT

A axis alignment device has been provided which permits a laser beam to be precisely aligned with a gun bore whose axis is being projected, for the purpose of aligning an optical sight. The axis alignment tool's onepiece body inherently improves the accuracy of the design, while being adaptable to mate with a large variety of gun bore sizes. The alignment device includes a universal seating mechanism for mounting in a muzzle. A bore adapter fits over one end of the one-piece body and is adjusted to snugly fit inside the bore. The alignment devices is designed to operate with an array of bore adapters, that fit a corresponding array of bore diameters. The alignment device also includes a rotary switch which acts as a battery housing, so that batteries can be changed without the disassembly of the alignment device.

18 Claims, 7 Drawing Sheets

A

AXIS ALIGNMENT APPARATUS

BACKGROUND OF THE INVENTION

This invention relates generally to a device which projects the axis of a bore, cylinder, or pipe and, more particularly, to an apparatus for aligning the bore of a gun for the purpose of calibrating the gun sights.

Several prior art devices exist for the operation of a laser sighting mechanism as a gun is actually fired. Once the laser is properly sighted, the laser-aided targeting scheme effectively increases a shooter's accuracy. Of course, a shooter must still account for the drop of a bullet as it loses velocity over distance, and for wind. However, a calibration process must first be performed which aligns the laser with the true alignment of the gun bore axis. This alignment process requires that several shots be fired so that the laser beam can be adjusted to alight on a target point that intersects the bullet path. Typically, the laser is used in conjunction with a conventional optical or iron sighting system.

Many other sighting systems exist which manage to co-align a laser beam with the gun bore axis. Then, the optical sighting system can be calibrated without the necessity of shooting, as the actual bullet path, excluding the effects of gravity and wind, can be clearly seen on a target surface. For these bore axis alignment systems to work properly, the laser must be supported so that the laser beam precisely aligns with the bore axis.

Some bore axis laser alignment systems build a laser into a simulated cartridge. However, the laser-cartridge does not always seat precisely, so that the bore alignment can be inaccurate. Further, different caliber laser-cartridges must be used for each different caliber gun which must be sighted. Each laser-bullet must also be independently powered.

Other alignment systems attempt to use a single laser for a variety of gun calibers, typically by loading an elongated laser alignment mechanism into the bore. To define a line, the laser alignment mechanism must be supported in at least two positions in the gun bore axis. The use of the muzzle is a logical point to both support and center the laser, and the body of a laser can easily be designed with a universal seating mechanism to seat in a variety muzzle diameters. Some seating mechanisms engage a tapered or conical body surface against the inside diameter of the bore. Other universal seating mechanisms form a ringlike trough to seat around the outside surface of the bore muzzle. A second support point is typically in the gun bore itself. This support point is especially critical if the first support point fits a number of bore sizes, so that it must be firmly lodged against the muzzle for proper centering of the alignment device. Thus, the problem with the second gun bore support mechanism is that it must fulfill the contradictory goals of precisely centering and seating the laser alignment device, while fitting a variety of bore diameters.

Prior art systems have solved this problem by making a laser alignment mechanism with detachable parts. A stem part of the laser mechanism, for insertion into the gun bore as the second support point, can be designed with a variety of diameters. Thus, a different diameter stem can be used for each diameter of gun bore that must be aligned. Although the laser and first (muzzle) support remains the same, a variety of stems must be maintained. As with the multiple laser-bullet solution, the number of parts required make it likely that some will be lost. Other systems reduce the number of parts by making the stem diameters deformable, so that one stem will fit in bores having very similar diameters. However, a variety of stem diameters are still required.

Even more critically, a system built of assembled parts can affect the accuracy of the laser alignment. A bore-mounted laser alignment system is not useful if the laser beam does not precisely follow the line of the bore axis. Even small differences between the alignment of the laser beam and the bore axis can seriously degrade accuracy in the process of optical sighting. Further, the error between the path of the laser beam and the actual bore axis increases as the distance between the gun and target increases.

Prior art systems typically comprise multi-piece housing which may include a laser, power supply, switch, and bore and muzzle support points. For the alignment system to work properly, the parts must be assembled in such a way that the laser beam is in consistent alignment with respect to the alignment device body axis, and that the alignment device body axis always match the bore axis. However, every part interface creates a potential laser beam alignment error. For example, if the system requires that the housing be disassembled to replace batteries, then the potential exists that the system will be misaligned every time the batteries are changed. Also, if the system requires the use of multiple stem-like parts to interface with a variety of bore diameters, then the possibility exists that the system will be misaligned every time a stem is changed. These errors can be reduced by producing parts to exacting tolerances, but rigid tolerance specifications increase the cost of the system. Alternately, the number of parts to be assembled can be minimized, but then the system may not be universal enough for use with all guns.

It would be advantageous if the axis of a bore or pipe could be sighted with a laser device, adaptable to fit into a wide variety of inside diameters.

It would be advantageous if a variety of guns, with different bore diameters, could be efficiently sighted, with the use of a single laser aligning device.

It would be advantageous if the number of parts interfaces in the alignment device could be minimized to reduce the source of potential errors and to minimize fabrications costs. To that end, a one-piece body, enclosing a laser would be effective.

It would be advantageous if the above-mentioned alignment process could be conducted in populated areas without firing a shot. Likewise, it would be advantageous if the axis sighting process could be conducted quickly.

SUMMARY OF THE INVENTION

Accordingly, an aligning device for projecting an axis is provided which can be used to align a gun's sights with the bore axis. The aligning device comprises a one-piece body to minimize the errors inherent in assembling multiple parts, as mentioned above. The body is elongated along an axis which is aligned with the gun bore axis. The body has a proximal end in which the laser is mounted and a distal end, which is inserted into the gun bore. Between the two ends is a universal seating mechanism to form a first contact region. It is called a universal seating mechanism because it seats the aligning device in a large range of bore diameters.

A bore adapter is attached to the body distal end. The outside diameter of the adapter forms a contact region with the inside diameter of the bore. The formation of the first and second contact regions by the universal seating mechanism and the bore adapter define the alignment of the body axis.

DETAILED DESCRIPTION OF THE PREFERRED EMBODIMENT

Figures 1A, 1B:
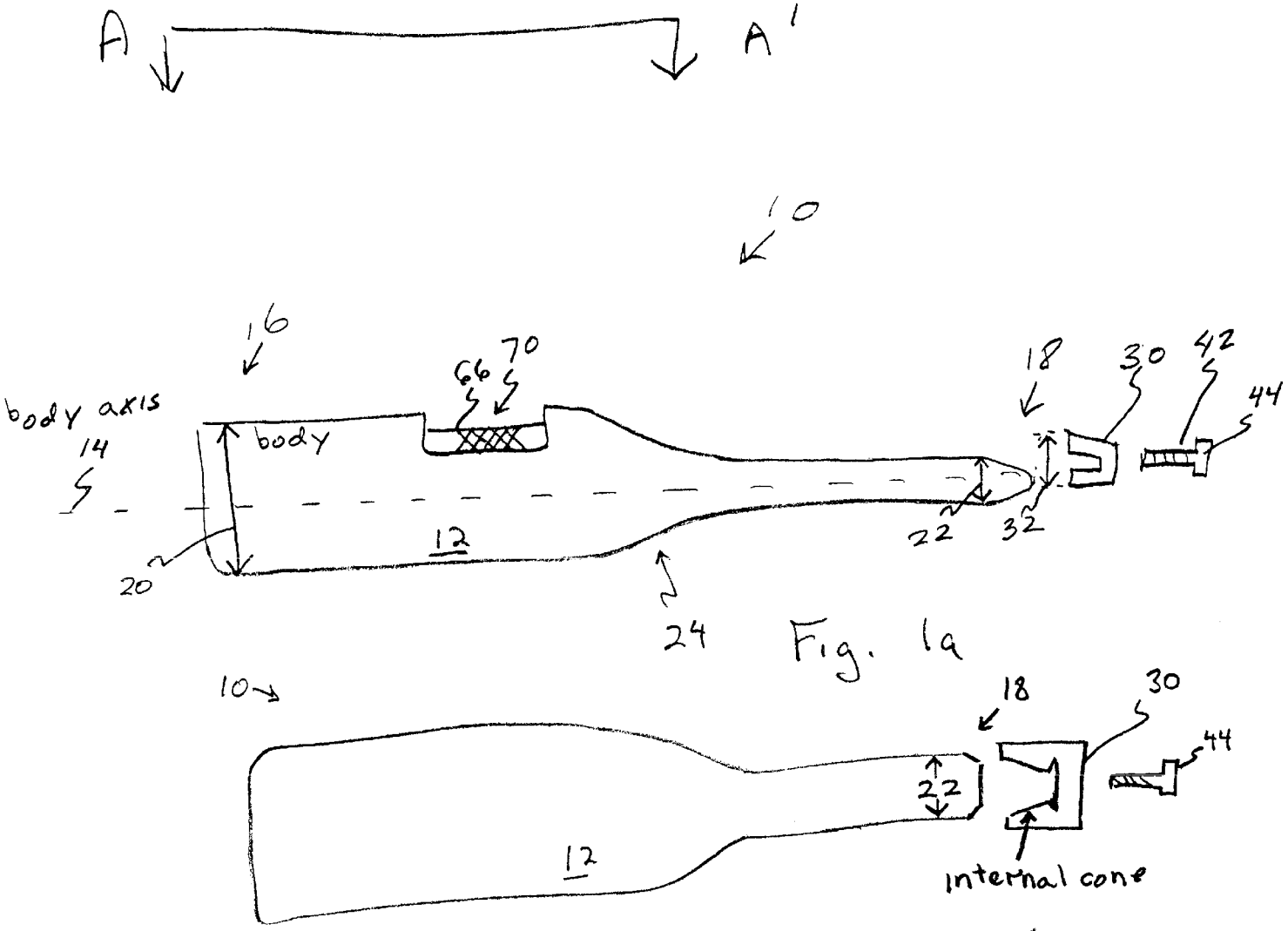
FIGS. 1*a* and 1*b* are side-views illustrating the present invention alignment device.

FIGS. 1*a* and 1*b* are side-views illustrating the present invention alignment device. The alignment device 10 includes a laser, mounted so that its beam is precisely aligned in the alignment device tool, and the device itself can be precisely aligned in the gun bore or cylinder whose axis is being projected. If either of the above-mentioned alignments is improper, it is unlikely that the laser beam will correctly align with the bore axis.

To that end, device 10 comprises a one-piece body 12 with a generally elongated shape along a body axis 14. The body 12 has a proximal end 16 and a distal end 18. At the proximal end 16 the body surface has a first diameter 20, while at the distal end 18 there is a second diameter 22 which is less that the first diameter 20. Between the proximal end 16 and distal end 18 is a conically-shaped universal seating mechanism 24.

Figure 2:
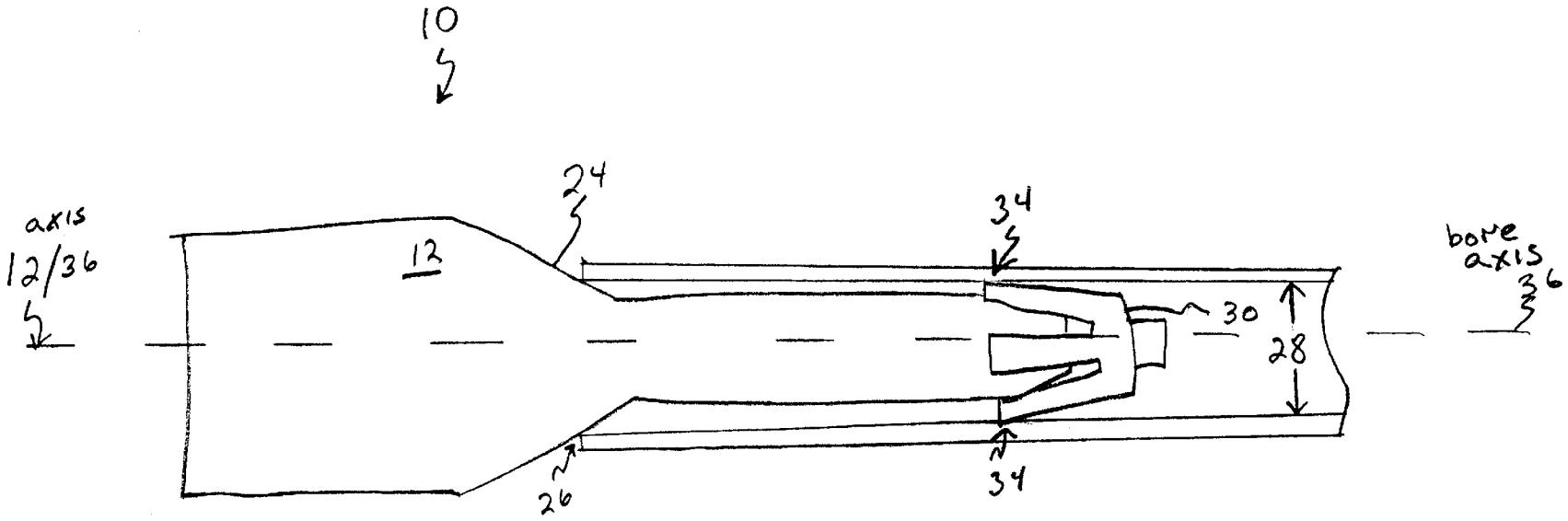
FIG. 2 illustrates the alignment device of FIG. 1*a* or 1*b* mounted in a cylinder or gun bore whose axis alignment is being projected.

FIG. 2 illustrates the alignment device of FIG. 1*a* or 1*b* mounted in a cylinder or gun bore whose axis alignment is being projected. The universal seating mechanism 24 is tapered to form a first, ring-like contact region 26, received in a gun muzzle or pipe end. The tapered surface of the universal mechanism 24 permit it to be interfaced with a large variety of inside bore diameters, from bores having an inside diameter 28 slightly less that the first diameter 20, to an inside bore diameter slightly greater the second diameter 22 (see FIGS. 1*a*and 1*b*).

Returning to FIGS. 1*a* and 1*b*, alignment device 10 also comprises a bore adapter 30 which is attached to the distal end 18. Bore adapter 30 has an adapter diameter 32. As shown in FIG. 2, the bore adapter 30 forms a second, substantially ring-like contact region 34 with the bore inside diameter 28. That is, the adapter diameter 32 is substantially the same as bore inside diameter 28. The first contact region 26 and the second contact region 34 define the alignment of body axis 12, and help ensure that the body axis 12 is aligned with the bore axis 36.

FIG. 1*a* illustrates an aspect of the invention where distal end 18 is a conically shaped part of the one-piece body 12. FIG. 1*b* illustrates a slightly different aspect of the invention where a conical shape is specifically formed into bore adapter 30. Then, the shape of distal end 18 becomes less critical. In some aspects of the invention, distal 18 has a small chamfer to interface with the internal cone shape of the bore adapter 30 of FIG. 1*b*. Note that once the bore adapter 30 of FIG. 1*b* is mounted on one-piece body 12, the device of FIG. 1*b* functions the same as the device of FIG. 1*a*.

Figure 3B:
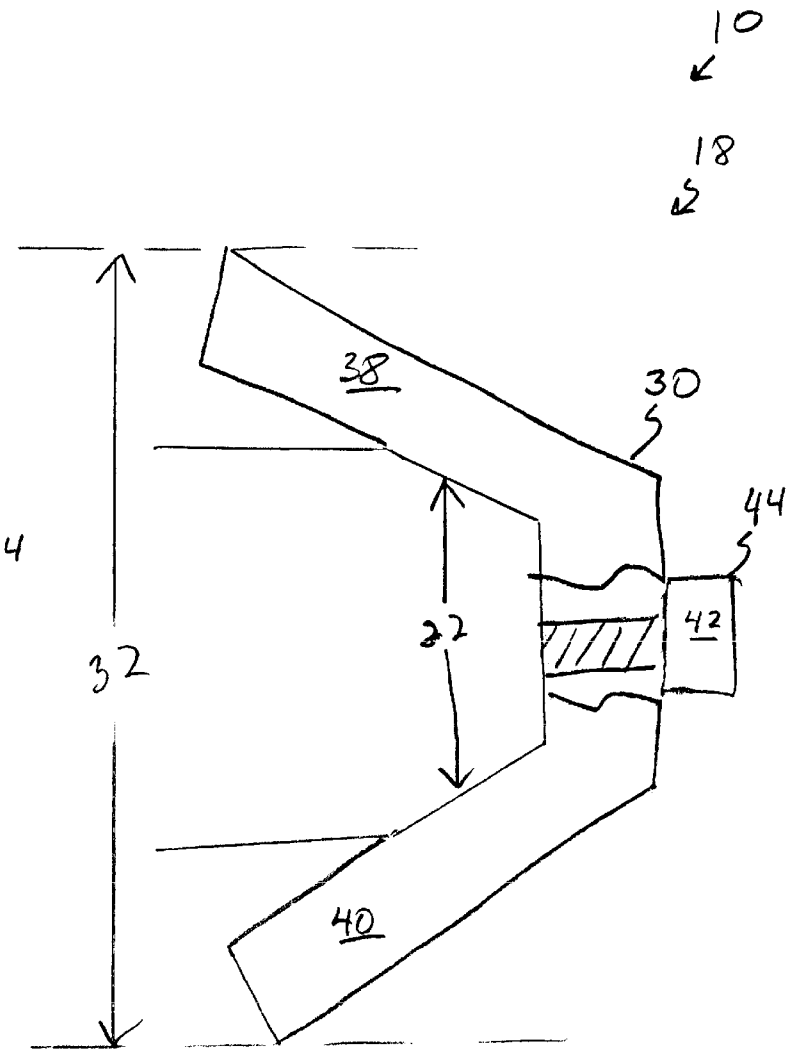
FIGS. 3*a* and 3*b* illustrate the variable diameter feature of the bore adapter.
Figure 3A:
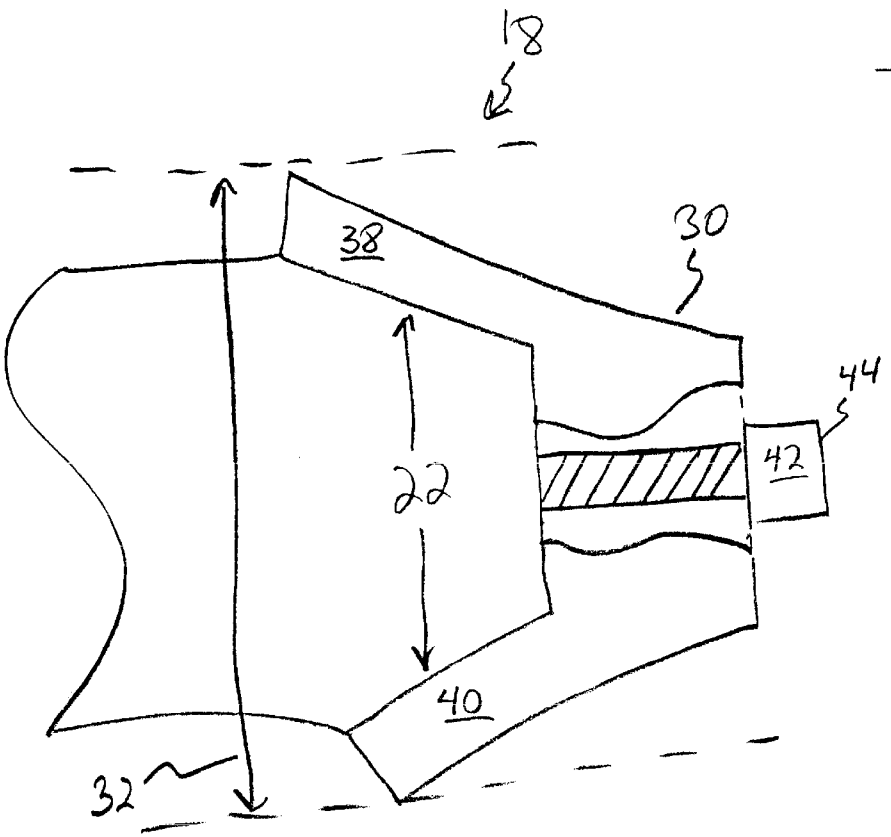

FIGS. 3*a* and 3*b* illustrate the variable diameter 32 feature of the bore adapter 30. The same size bore adapter 30 is shown in FIGS. 3*a* and 3*b*. The bore adapter 30 includes deformable fingers, such as fingers 38 and 40. Note that although only two fingers are shown in these figures, and four fingers are shown in figures described below, the invention is not limited to a specific number of fingers. The bore adapter fingers 38 and 40 sidably overlie body distal end 18. A screw 42 is used to attach bore adapter 30 to distal end 18. A screw head 44 captures bore adapter 30 and forces it against the distal end 18, regardless of whether the distal end 18 is part of the one-piece body (FIG. 1*a*) or a bore adapter 30 with an internal cone shape is used (FIG. 1*b*). The adapter diameter 32 and the deformation of fingers 38 and 40 are responsive to the pressure, applied by the screw 42, to the bore adapter 30. Alternately stated, the fingers 38 and 40 are splayed to form differently sized adapter diameters 32. In some aspects of the invention, as shown in FIGS. 3*a* and 3*b*, the distal end second diameter 22 is tapered, with a smaller diameter at the extreme distal end 18. This taper cooperates with the splayed fingers 38 and 40 to increase the adapter diameter 32 in response to pressure applied by the screw 42. In this manner, the same bore adapter 30 can be used with a variety of similar inside bore diameters.

Figure 4:
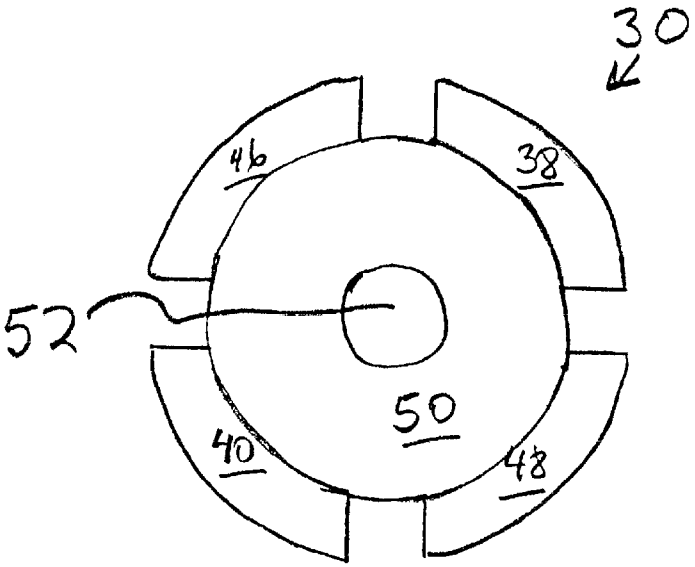
FIG. 4 illustrates an end view of bore adapter.

FIG. 4 illustrates an end view of bore adapter 30. The particular bore adapter 30 shown in FIG. 4 has four fingers, fingers 38, 40, 46, and 48. The bore adapter 30 also includes a ring 50, or some similar structure to accept the screw 42 (not shown) in a hole 52. The fingers 38, 40, 46, and 48 are axially disposed and attached to ring 50. In other aspects of the invention, not shown, the ring 50 is only slightly larger than the screw hole 52, and the fingers, where attached, are not perpendicular, but are more gradually bent into a position perpendicular to the ring 50.

Figure 5:
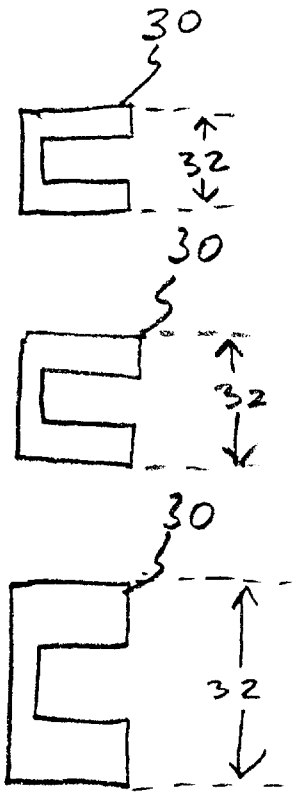
FIG. 5 illustrates a plurality of differently sized bore adapters.

FIG. 5 illustrates a plurality of differently sized bore adapters 30. As shown in FIGS. 3*a* and 3*b*, the adapter diameter 32 can be varied with the use of screw 42. However, to cover a wide range of bore inside diameters it may be more practical to provide a plurality of differently sized bore adapters 30, which all have different nominal adapter diameters 32, which each can be varied with adjustment screw 42, as discussed above and shown in FIGS. 3*a* and 3*b*. A user selects a bore adapter 30 with a diameter 32 that approximately conforms with the bore inside diameter, and then that specific adapter 30 is modified with screw 42 for an exact fit. Even without adjustment of screw 42, the bore adapter 30 fits to conform with a large variety of bore inside diameters.

It should be noted that the bore adapter 30 is made out of a flexible material such as nylon or plastic. Even though the bore adapter is a moving part, it adds very little to the inaccuracy of the system since the bore adapter 30 generally conforms to the precision-formed device distal end 18 (FIG. 1*a*) or the bore adapter 30 has an internal cone shape (FIG. 1*b*) which remains substantially the same as adjustments are made to fit the alignment device 10 into a gun bore.

Figures 6A, 6B:
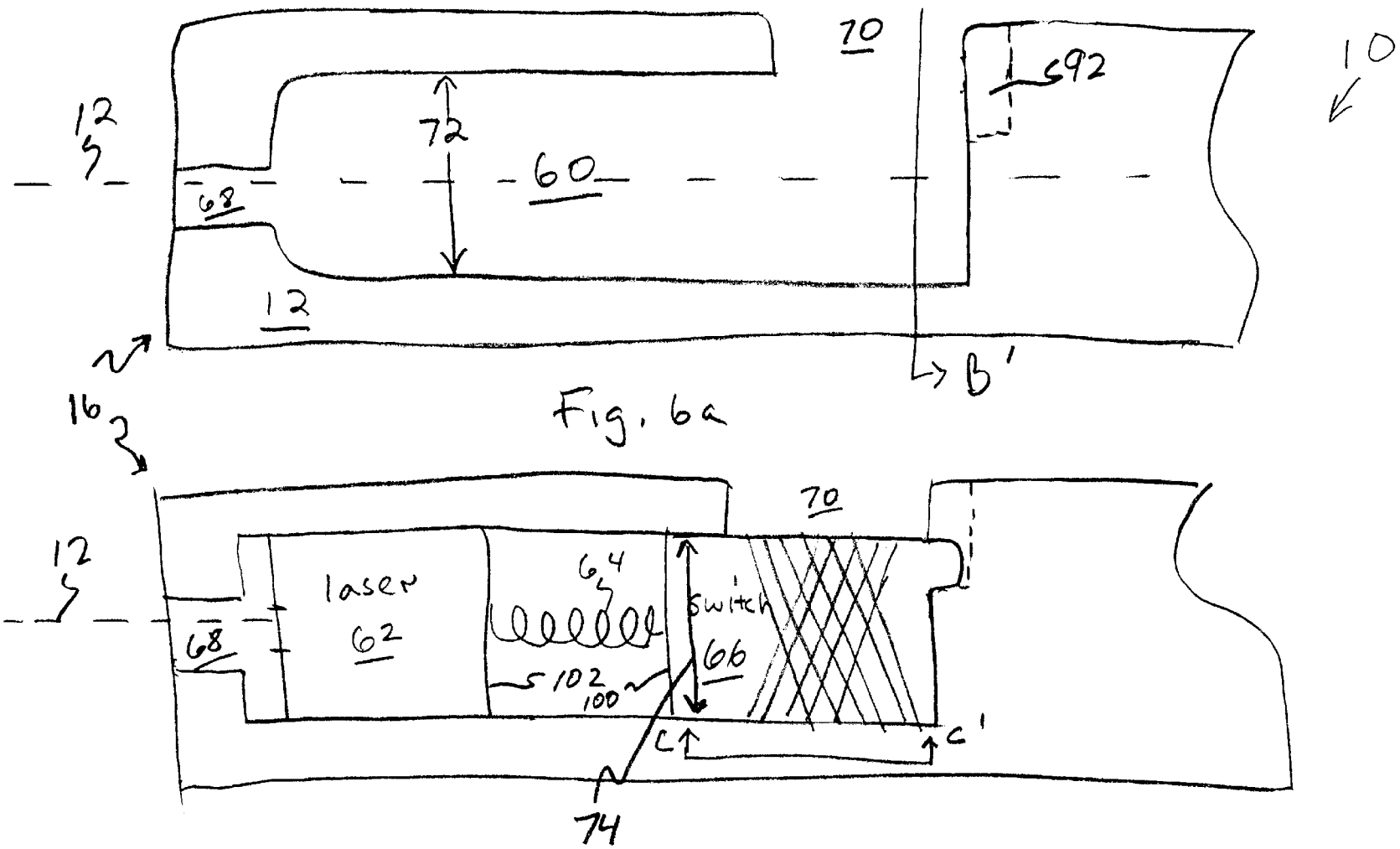
FIGS. 6*a* and 6*b* are partial cross-sectional illustrations of the alignment device of FIGS. 1*a* or 1*b*, depicting the first cylindrical cavity.

FIGS. 6*a* and 6*b* are partial cross-sectional illustrations of the alignment device 10 of FIG. 1*a* or 1*b*, depicting the first cylindrical cavity. For clarity, FIG. 6*a* shows the first cavity 60 without components, while FIG. 6*b* shows the first cavity 60 with components. The first cavity 60 has an axis that is aligned with body axis 12, and is located between the proximal end 16 and the, universal seating mechanism 24 (see FIG. 1*a*). As shown in FIG. 6*b*, the first cavity 60 houses a light source 62, typically a laser, an electrically conductive spring 64, and a rotary switch 66. The light source 62 is permanently mounted in the housing so that it need not be removed to change batteries or to make support adjustments. The light source 62 emits a beam that is alignment with the body axis 12. The switch 66 is rotated to selectively connect the light source 62 to a power supply. As is explained below, the spring keeps switch 66 locked into a position, either on or off, and provides an electrical path to the laser light 62. As is shown more clearly in FIG. 1*a*, the body 12 includes a channel 70 formed between the body surface and the first cavity 60 to expose the switch 66. The switch 66 can be accessed for rotation through channel 70.

Also shown in FIGS. 6*a* and 6*b*, the body proximal end 16 includes a second cylindrical cavity 68 connected to the first cavity 60. The second cavity 68 is aligned with the body axis 12 to form an opening from which the light source beam is projected.

The first cavity 60 has a cavity diameter 72 (FIG. 6*a*). The switch 66 is a cylinder with a switch diameter 74 (see FIG. 6*b*) which is less than the cavity diameter 72, so that switch 66 has the freedom to rotate. The switch 66 has an axis substantially aligned along the body axis 12. The switch 66 rotates through the switch axis to selectively connect the power source to the light source 62.

Figure 7:
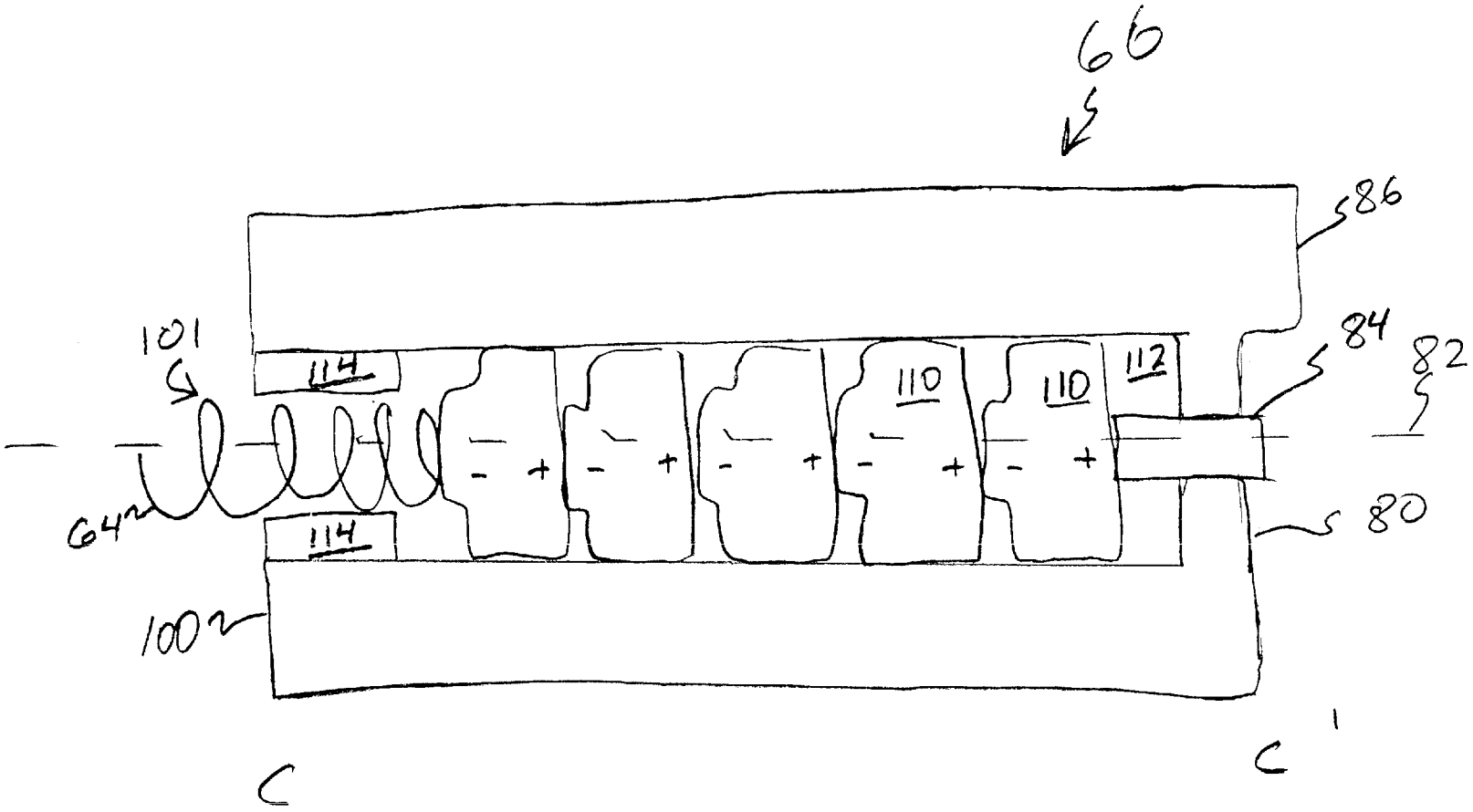
FIG. 7 is a partial cross-sectional view of the switch of FIG. 6*b*.

FIG. 7 is a partial cross-sectional view of the switch 66 of FIG. 6*b*. The switch 66, which is substantially shaped like a cylinder which has a "top", or first outside surface 80 which is radially disposed around the switch axis 82. The first surface 80 has a conductive area 84. A conductive rod 84 is specifically shown, but other connection means could also be used. The first surface 80 also includes a cam 86.

Figure 8:
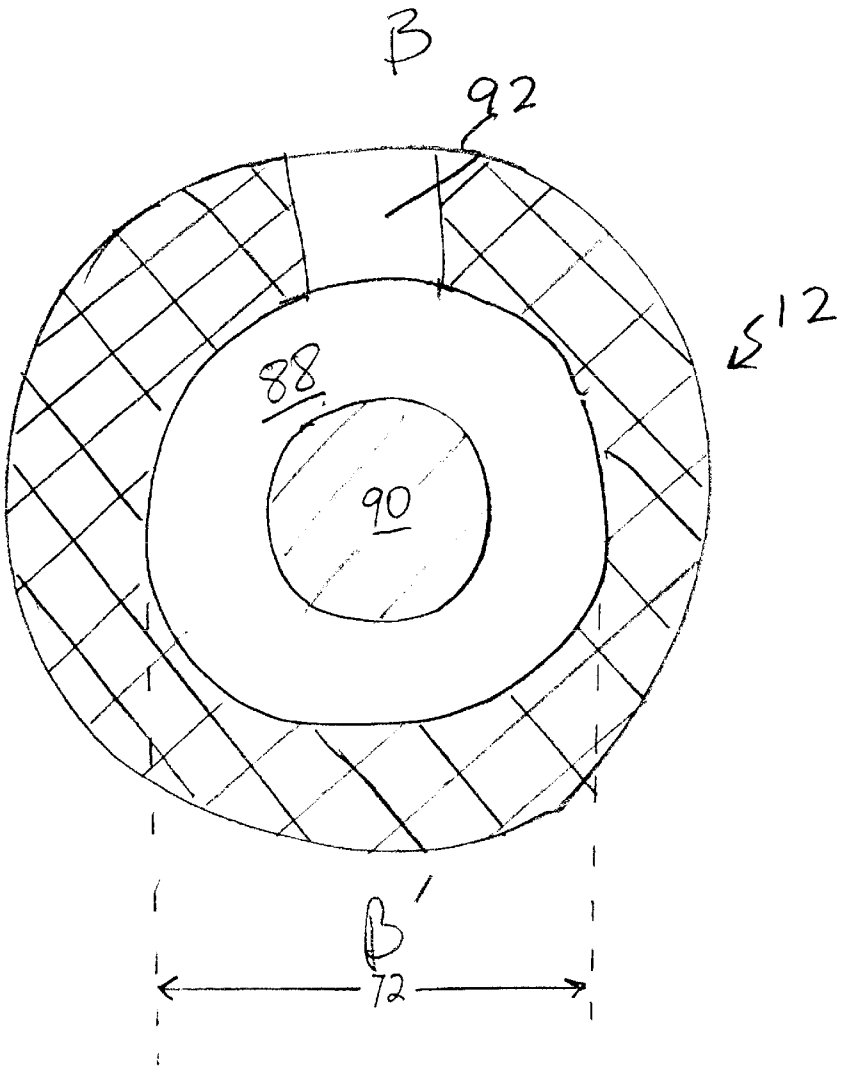
FIG. 8 is a partial cross-sectional view of the body of FIG. 6*a*.

FIG. 8 is a partial cross-sectional view of the body 12 of FIG. 6*a*. The first cavity 60 (see FIG. 6*a*) has a second surface 88 which interfaces with the switch first surface 80, see FIG. 7, which is radially disposed around the body axis 12. The second surface 88 includes a second conductive area 90. An electrical connection is made between the body 12 and the switch 66 when the second conductive area 90 interfaces with the first conductive area 84 (FIG. 7). The second surface 88 also includes a channel, or recessed area 92, represented as the area in the exterior ring which is not double cross-hatched. When the channel 92 receives the switch cam 86, an electrical connection is made between first conductive area 84 and second conductive area 90. Note, that the conductive areas are not limited to any special shape or placement on the surface for operation. For example, the conductive areas can be centered around the axis. When the cam 86 is not in the channel 92, the first surface 80 and second surface 88 are forced apart, and no electrical connection is made. It should also be noted that the shapes of the cam 86 and the channel 92 are not limited merely to the depicted example.

Returning to FIG. 7, the switch 66 has a third outside surface 100 radially disposed around the switch axis 82, having a third conductive area 101. In the simpler aspects of the switch 66, where the switch 66 operates as a passive electrical conductor, the third conductive area 101 can be a conductive rod, such as the depicted first conductive area 84. In some aspects, the conductive rod passes all the way through switch 66 from the first surface 90 to the third surface 100. Alternately, the switch can be a metal, such as aluminum, which is anodized or coated with an insulator, except for areas on the first surface 80 and third surface 100 which act as conductive areas 84 and 101, so that the switch body 66 acts as a conductor. As explained in more detail below, the switch 66 acts as a battery housing in some aspects of the invention, and the third conductive area can be considered the battery terminal, the spring 64, or the combination of battery and spring 64.

Returning to FIG. 6*b*, the first cavity 60 has a fourth surface 102 radially disposed around the body axis 12, having a fourth conductive area which is not explicitly shown. The fourth surface can be a part of the body 12, as is the second surface 88 (see FIG. 8). However, as depicted in FIG. 6*b* the fourth surface is actually the light source 62 electrical terminal. Also as shown, the electrically conductive spring 64 is substantially aligned along the body axis 12 between the third surface 100 and fourth surface 102 surfaces. Therefore, when the switch 66 is "on", with the cam 86 being engaged with channel 92, the second conductive area 90 is connected to the fourth conductive area 102 through the switch 66 and spring 64.

In some aspects of the invention the power supply is housed elsewhere in the body 12 (not shown). The switch 66 acts as a selectively engagable passive conductor which completes an electrical circuit between the second conductive area 90 and fourth conductive area 102, from a battery, to the light source, with the return ground path from the light source 62 being through the electrically conductant body 12. However, in a preferred aspect of the invention the batteries are housed in the switch 66. Since the switch 66 is already a moving part, and not involved in aligning the body axis 12 with the bore axis, the removal the switch 66 to replace batteries does not affect the accuracy of alignment device 10. The switch 66 is easily removed through channel 70.

As shown in FIG. 7, a number of "wristwatch" type batteries 110 are arranged end-to-end in a battery cavity 112. The cavity 112 can also be designed to accommodate other battery styles. The battery 110, or series combination of batteries 110 have a first polarity (+) connected to the switch's first conductive area 84 and a second polarity (−) connected to the switch's third conductive area 101. In some aspects of the invention an axial plug 114, with a center hole to admit spring 64, seals the end of battery cavity 112

A laser alignment device, useful for sighting the true axis of a bore has been described. However, the device is also useful in civil engineering tasks, such as construction projects using pipe or tubing, in oil field pipe applications, large machine construction, or prefabricated housing. A unique rotary switch/battery housing combination has also been described. An example of a one-piece body and rotary switch has been provided as an example. However, the present invention is not limited to merely the depicted examples. Other variations and embodiments of the above-described invention will occur to those skilled in the art.

What is claimed is:

1. An alignment device for projecting an axis, the alignment device having a body axis and comprising:

a body, having a proximal end, a distal insertable end, and a universal seating mechanism to form a first contact region;

a bore adapter attached to the distal insertable end having a variable adapter diameter to form a second contact region, the bore adapter comprising an attachment means for capturing the bore adapter against the distal insertable end;

a light source attached to the body so as to emit a beam aligned with the body axis; and wherein the bore adapter includes deformable members defining the variable adapter diameter, which deform in response to the engagement of the attachment means.

2. The alignment device of claim 1 wherein the body has an surface with a first diameter at the proximal end and a second diameter less than the first diameter at the distal end, and wherein the universal seating mechanism is a tapered diameter section of the body surface between the proximal and distal ends.

3. The alignment device of claim 1 wherein the adapter diameter is variable to form a plurality of second contact region sizes.

4. The alignment device of claim 1 further comprising:

a plurality of attachable bore adapters having a corresponding plurality of adapter diameters.

5. The alignment device of claim 1 wherein the body distal end is conically shaped to provide a tapered first diameter; and wherein the bore adapter deforming members are fingers slidably overlying the conical shaped body distal end, splaying to define the variable adapter diameter.

6. The alignment device of claim 1 wherein the bore adapter includes a ring to admit the screw, and wherein the deformable fingers are axially attached around the ring.

7. The alignment device of claim 1 further comprising:

a power source connected to the light source.

8. The alignment device of claim 7 further comprising:

a switch to selectively connect the power source to the light source.

9. The alignment device of claim 8 wherein the body includes a first cylindrical cavity with a cavity diameter, having an axis aligned With the body axis to house the light source, the switch, and the power source.

10. The alignment device of claim 9 wherein the body proximal end includes a second cylindrical cavity connected to the first cavity, and aligned with the body axis, to form an opening from which the light source beam is projected.

11. The alignment device of claim 10 wherein the body includes a channel formed between the body surface and the first cavity to expose the switch; and wherein the switch is a cylinder with a switch diameter less than the cavity diameter, having an axis substantially aligned along the body axis, and wherein the switch is rotatable through the switch axis to selectively connect the power source to the light source.

12. A The alignment device of claim 11 wherein the switch includes a first outside surface, radially disposed around the switch axis, having a first conductive area and cam;

wherein the first cavity has a second surface, radially disposed around the body axis, having a second conductive area and a channel to receive the switch cam; and wherein the switch cam cooperates with the second surface channel to selectively connect the first and second conductive areas.

13. The alignment device of claim 12 wherein the switch has a third outside surface radially disposed around the switch axis, having a third conductive area, and wherein the first and third conductive areas are connected through the switch;

wherein the first cavity has a fourth surface radially disposed around the body axis, having a fourth conductive area; and further comprising:

an electrically conductive spring substantially aligned along the body axis between the third and fourth surfaces; and wherein the second and fourth conductive areas are selectively connected through the switch and spring.

14. The alignment device of claim 13 wherein the body includes a conductive path, through the light sources, between the second and fourth conductive surfaces;

wherein the switch includes a battery cavity;

wherein the power source includes at least one battery, housed in the switch's battery cavity, having a first polarity connected to the switch's first conductive area and a second polarity connected to the switch's third conductive area; and wherein the light source is selectively powered with the battery.

15. The alignment device of claim 1 wherein the light source is a laser.

16. A laser device for sighting an axis:

a one-piece body, elongated along a body axis, having a proximal end, a distal end, and a universal seating mechanism to define a first contact region;

a bore adapter attached to the body distal end to form a second contact region;

a first cavity formed in the body; and a laser, including a power supply, mounted in the first cavity to emit a beam along the body axis.

17. A gun bore axis aligning device comprising:

a body having a proximal end and a distal end insertable into a gun bore, the body having a surface with a first diameter at the proximal end, a second diameter less than the first diameter at the distal end, and a tapered diameter section between the first and second diameters to engage the gun muzzle when the distal end is inserted into the bore;

a bore adapter attached to the body distal end having an adapter diameter to engage the gun bore;

a first cavity formed in the body;

a laser mounted in the first cavity of the body so as to emit a beam aligned with the gun bore axis; and, a switch housed in the first cavity to selectively connect the laser to a power source.

18. A carrier for housing a light source used to align a bore axis within a bore comprising:

a body section designed to extend at least partially into the bore, the body section comprising:

a first contact section designed to contact the inside of the bore;

a second contact region designed to contact the bore; and a first cavity formed in the body section to house the light source, the first cavity designed to extend at least partially into the bore.

* * * * *